US009015864B2

(12) United States Patent
Evans et al.

(10) Patent No.: US 9,015,864 B2
(45) Date of Patent: Apr. 28, 2015

(54) INTEGRATED GARMENT SYSTEM

(75) Inventors: Lindsay M. Evans, Ashland, OR (US); Martin L. Flora, Ashland, OR (US); Maria-Paz S. Santo, Medford, OR (US); Theodore J. Trombly, Ashland, OR (US)

(73) Assignee: Massif Mountain Gear Company, LLC, Ashland, OR (US)

( * ) Notice: Subject to any disclaimer, the term of this patent is extended or adjusted under 35 U.S.C. 154(b) by 303 days.

(21) Appl. No.: 13/028,682

(22) Filed: Feb. 16, 2011

(65) Prior Publication Data

US 2012/0204313 A1 Aug. 16, 2012

(51) Int. Cl.

| | |
|---|---|
| ***A41D 15/00*** | (2006.01) |
| ***A41F 5/00*** | (2006.01) |
| *A41D 31/00* | (2006.01) |

(52) U.S. Cl.

CPC ..... *A41F 5/00* (2013.01); *A41D 31/0022* (2013.01)

(58) Field of Classification Search

CPC ..... A41D 15/00; A41D 1/22; A41B 9/08; A62B 17/003

USPC ..... 2/456–458, 70–73, 75–76, 79–81, 2.14, 2/230, 321, 78.4, 107, 112, 117, 229; 24/72.5, 72.1, 3.13, 3.12, 465

See application file for complete search history.

(56) References Cited

U.S. PATENT DOCUMENTS

| | | | | | |
|---|---|---|---|---|---|
| 533,373 | A | * | 1/1895 | Presby | 24/369 |
| 932,640 | A | * | 8/1909 | Pfiffner | 2/70 |
| 1,531,984 | A | * | 3/1925 | Schlissel | 2/70 |
| 1,537,230 | A | * | 5/1925 | Godbehere | 2/79 |
| 1,611,420 | A | * | 12/1926 | Cuddy | 2/79 |
| 2,180,346 | A | * | 11/1939 | Brewster | 2/229 |
| 2,637,040 | A | | 5/1953 | Kay | |
| 2,724,118 | A | * | 11/1955 | Saftlas | 2/70 |
| 3,418,659 | A | * | 12/1968 | Brown | 2/70 |
| 5,027,440 | A | | 7/1991 | Morris et al. | |
| 5,062,159 | A | * | 11/1991 | Jakub | 2/114 |
| 5,245,993 | A | | 9/1993 | McGrady et al. | |
| 5,255,392 | A | | 10/1993 | Stanislaw | |
| 5,318,018 | A | | 6/1994 | Puma et al. | |
| 5,488,738 | A | * | 2/1996 | Seamans | 2/69 |
| 5,509,147 | A | | 4/1996 | Busquets | |
| 5,724,678 | A | | 3/1998 | McCallum et al. | |
| 5,853,396 | A | | 12/1998 | Bennes et al. | |
| 6,282,717 | B1 | * | 9/2001 | Ng | 2/70 |
| 6,696,145 | B2 | * | 2/2004 | Holman | 428/314.4 |
| 6,751,805 | B1 | | 6/2004 | Austion | |

(Continued)

*Primary Examiner* — Amy Vanatta
*Assistant Examiner* — Sally Haden
(74) *Attorney, Agent, or Firm* — Dority & Manning, P.A.

(57) ABSTRACT

A modular garment system includes an attachment system for attaching multiple garments together. In one embodiment, the garment system includes an upper body garment that is attachable to a lower body garment. The upper body garment includes a plurality of connectors that are aligned with a plurality of retaining members on the lower body garment. The retaining members on the lower body garment, for instance, may be placed on top of existing belt loops. The retaining members may include a flap, while the connectors may have a loop-like structure. In order to connect the upper body garment to the lower body garment, the flap may be inserted into the loop-like structure and secured to the lower body garment. The upper body garment can also include a draw cord that can be used to further secure the upper body garment against the lower body garment.

24 Claims, 6 Drawing Sheets

(56) References Cited

U.S. PATENT DOCUMENTS

| | | | | |
|---|---|---|---|---|
| 7,043,766 | B1 * | 5/2006 | Foreman et al. | 2/81 |
| 8,250,671 | B2 * | 8/2012 | Shadid | 2/94 |
| 2003/0131401 | A1 * | 7/2003 | Dilworth et al. | 2/457 |
| 2008/0016602 | A1 | 1/2008 | Baldwin | |
| 2008/0034478 | A1 * | 2/2008 | Patterson | 2/239 |
| 2009/0070915 | A1 * | 3/2009 | Hill | 2/117 |
| 2009/0172862 | A1 * | 7/2009 | Sheward et al. | 2/114 |
| 2009/0289046 | A1 * | 11/2009 | Richmond | 219/211 |

* cited by examiner

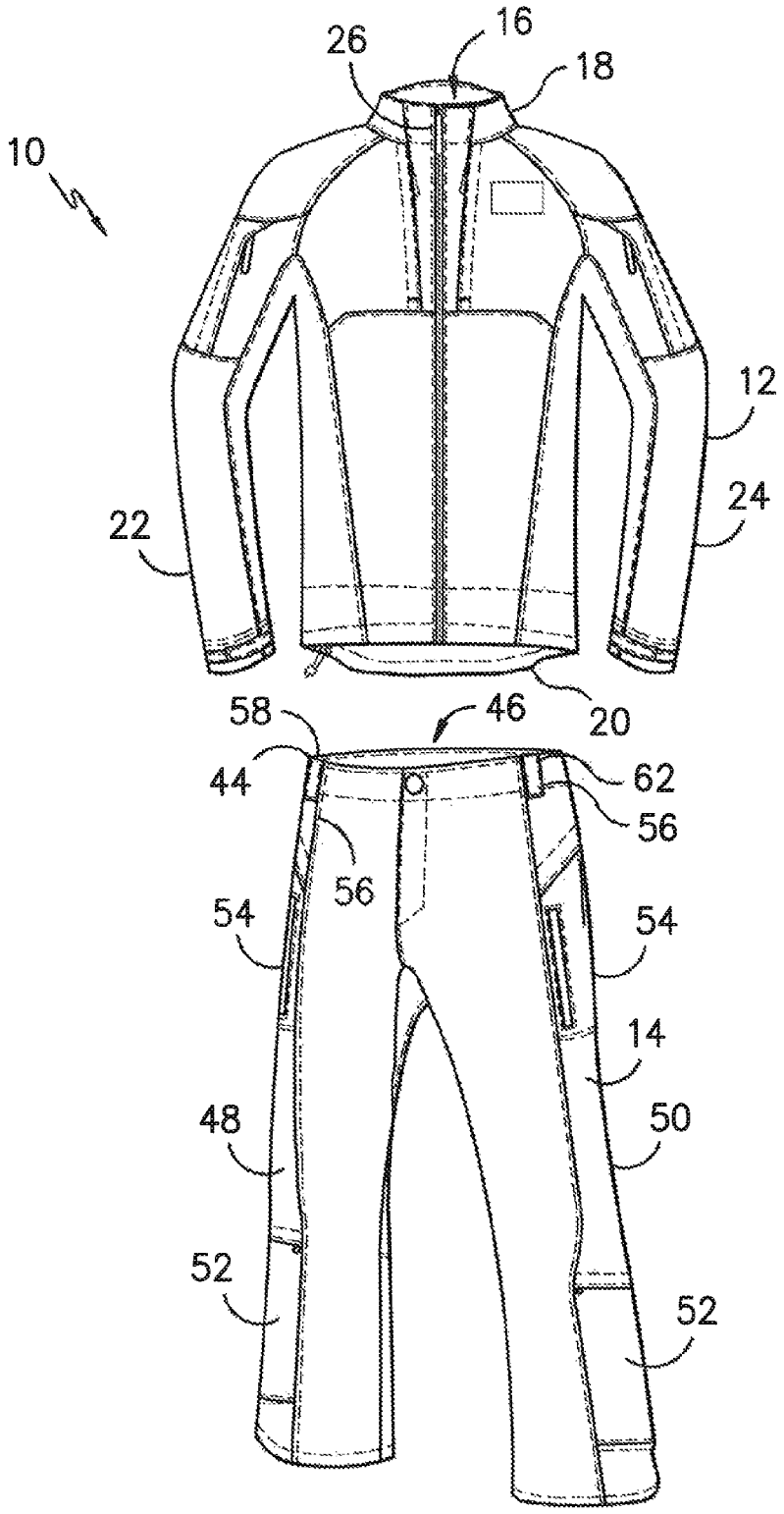
FIG. —1—

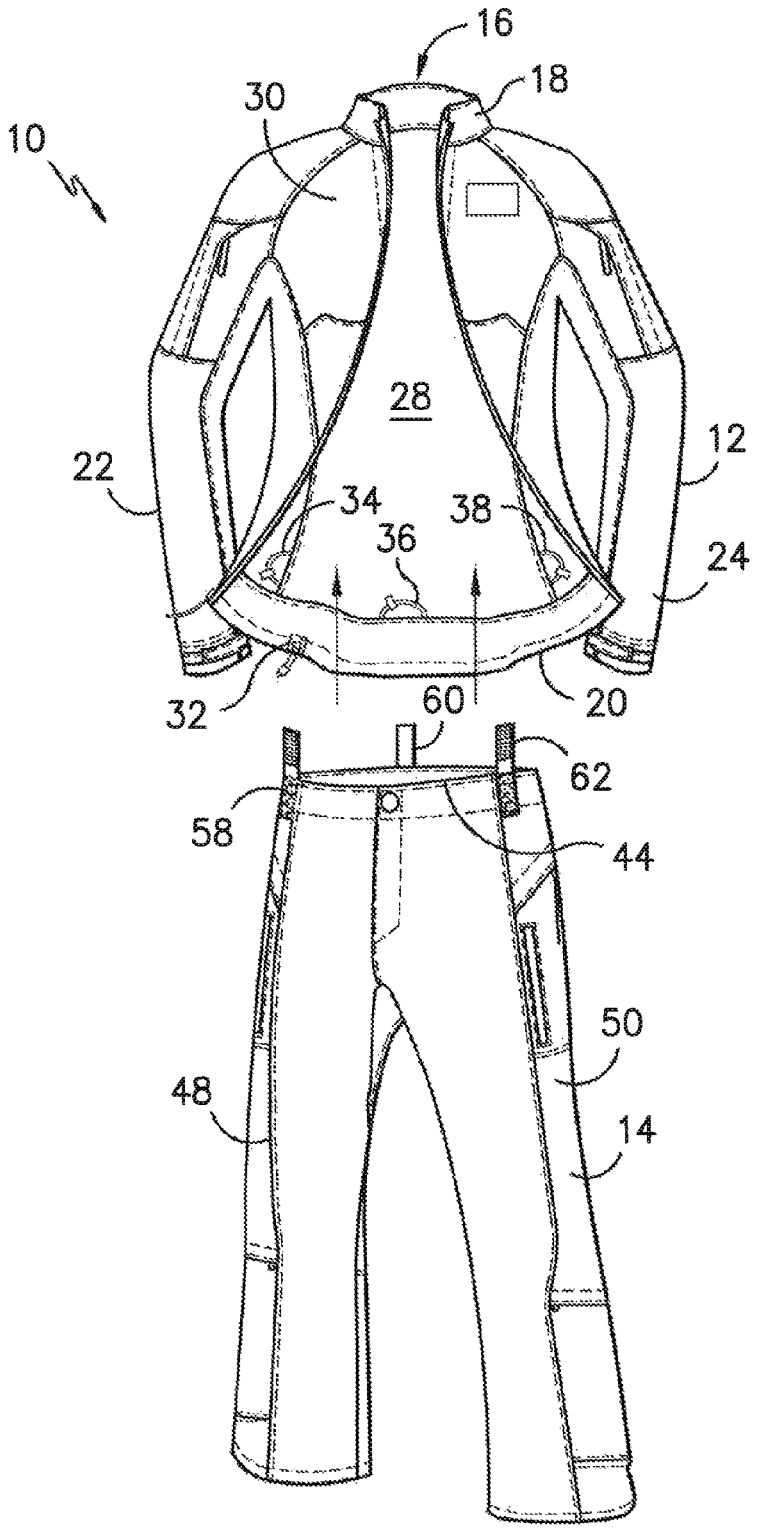
FIG. –2–

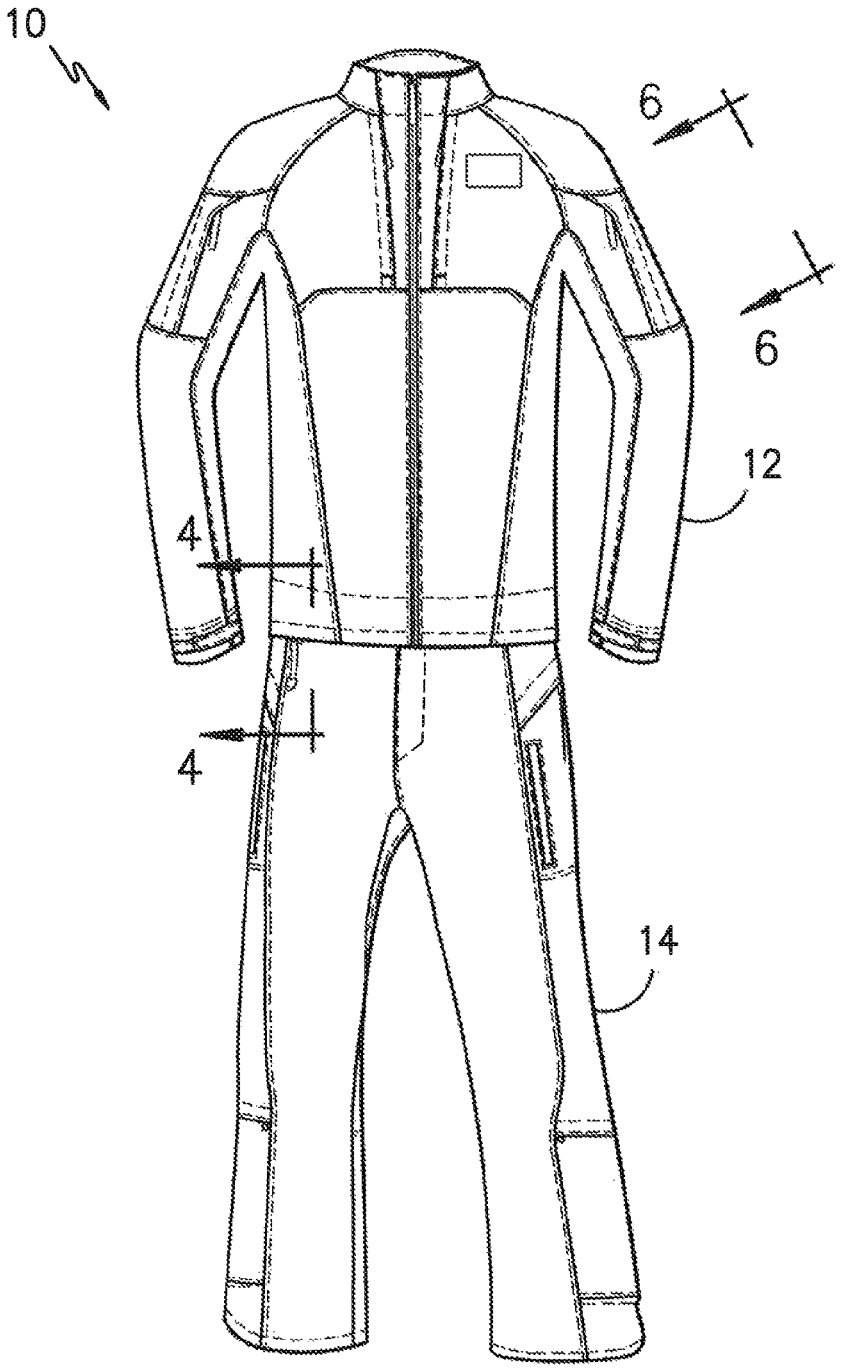
FIG. –3–

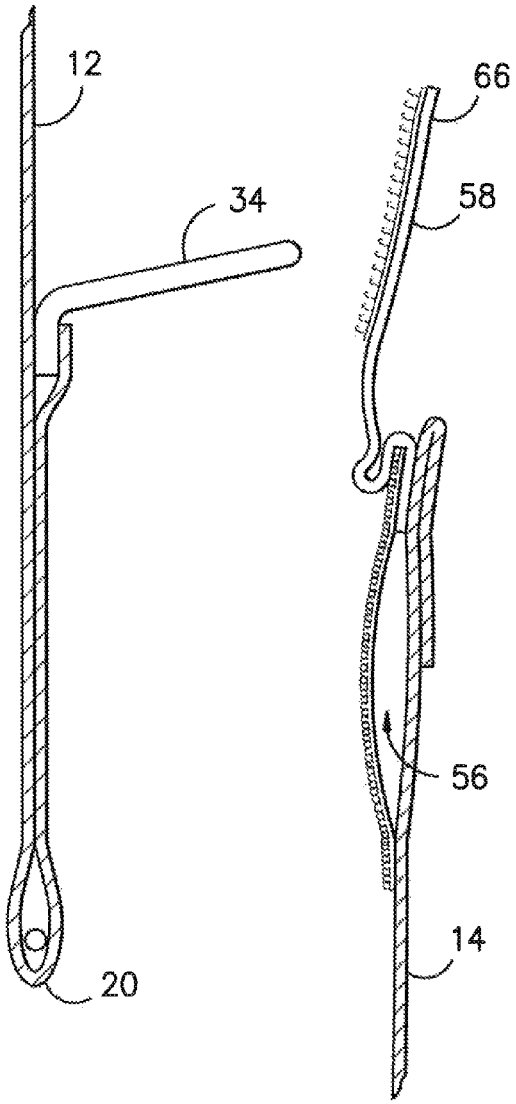
FIG. —4A—
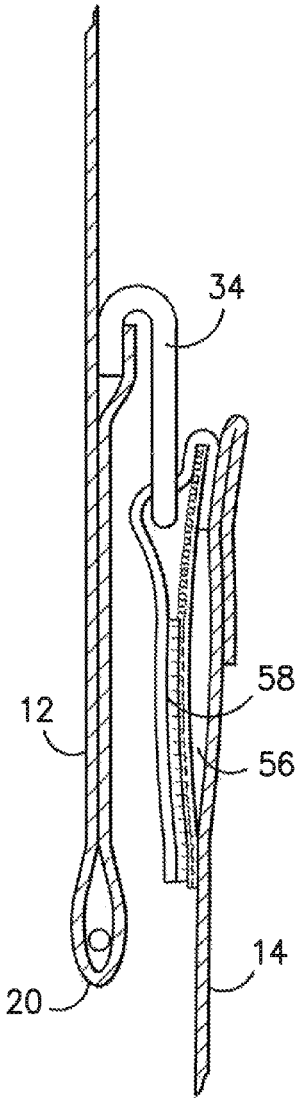
FIG. —4B—

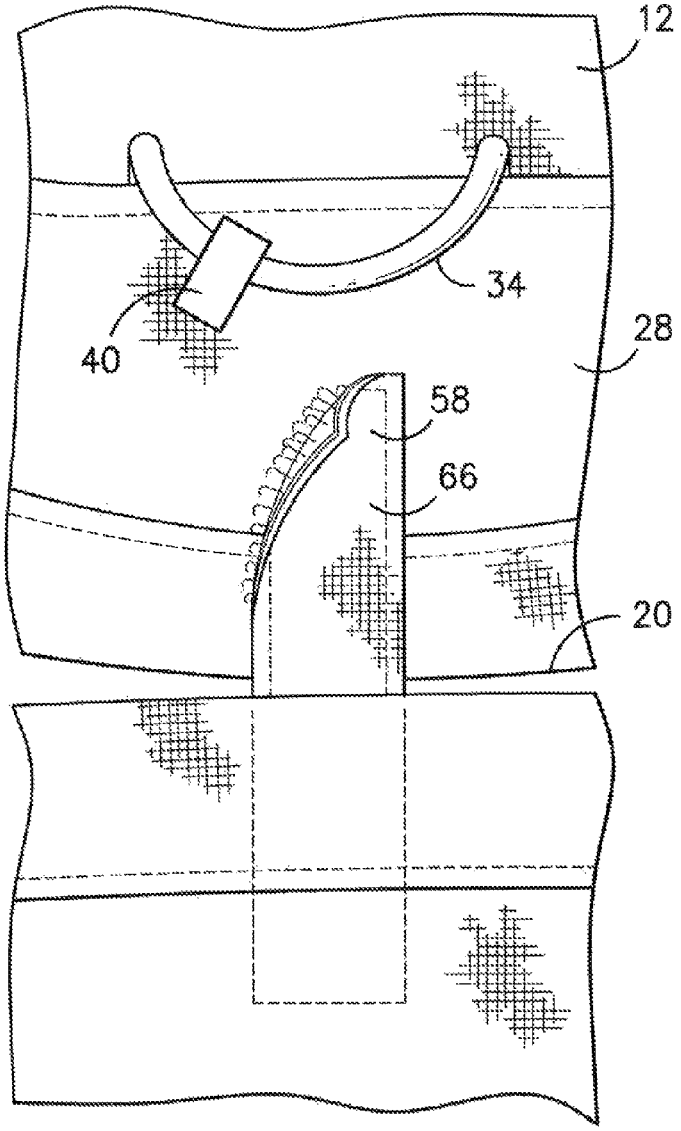
FIG. –5–

INTEGRATED GARMENT SYSTEM

BACKGROUND

Flame resistant fabrics are used in a variety of different applications. For example, many garments are made from flame resistant fabrics that are intended to protect the wearer in environments where the wearer may be exposed to fires and open flames. For instance, flame resistant garments are typically worn by firefighters, military personnel, industrial workers, race car drivers, and pilots.

Flight suits worn by pilots, for instance, are typically not only designed to protect against fires and open flames, but are also constructed so as to protect the pilot from other various environmental and aircraft-induced hazards. For military pilots that fly certain types of missions, the flight suit should also protect the pilot in combat and other emergency situations.

Various hazards that a flight crew may be exposed to include fire in the aircraft, wind blasts, exposure to noxious chemicals, and exposure to very low temperatures at high altitude. During an emergency ejection or a crash, flight crews can also be exposed to ground fire or cold water immersion. If performing military functions, the flight crew may also be exposed to chemical and biological weapons, flash fires, incendiary devices, and the like.

To be effective, a flight suit should perform as an integrated system that provides protection to the flight crew while still allowing the flight crew to perform their functions.

In the past, for instance, flight suits have been proposed that comprise a single garment that covers the legs, torso, chest and arms of the wearer. Single-piece garments, however, have various drawbacks and disadvantages. Single-piece garments, for instance, may be cumbersome to wear, especially when not operating an aircraft. Single-piece garments also provide little adjustment for size and fit unless the garment is particularly tailored for an individual.

In other embodiments, flight crews have been provided with an assortment of garments that each have a different function. Although the garments are well suited to providing protection for a particular hazard, the separate garments may not be designed to interface with other garments in a way that optimizes overall protection and comfort. For example, in order to be protected against all possible hazards, the garments may have to be worn in layers which reduces comfort and mobility. Further, when assembled together, the garments may not provide overall protection against open flames and fires. Particular garments may provide some flame resistant properties to some parts of the body but may leave other parts of the body exposed.

In view of the above, a need currently exists for an integrated garment system that can provide protection to a wearer while still providing maximum comfort and mobility. For example, a need currently exists for a modular garment system that is relatively simple to assemble and is more secure thereby providing greater protection to the wearer in comparison to many prior products.

SUMMARY

In general, the present disclosure is directed to a modular garment system. The modular garment system can be used in any suitable application or environment. In one embodiment, for instance, the garments can be made from a flame resistant fabric. The fabric, for example, can include flame resistant fibers and/or be treated with a flame retardant composition. When made from a flame resistant fabric, the different garments contained in the garment system can be attached together to provide an overall integrated garment system well suited to protecting a wearer from fires and open flames.

Because the garment system is modular, the garments are comfortable to wear and provide a full range of motion to the wearer. The garment system is particularly well suited for use by flight crews, including pilots. In one particular application, for instance, the garment system can be designed to be worn by a flight crew during military operations. The garment system, however, may be used in various other applications as well. For instance, the garment system is well suited for use by firefighters, industrial workers, police and other security personnel, and the like.

In one embodiment, the garment system includes an upper body garment and a separate lower body garment. The upper body garment can include a pair of opposing arm openings and a bottom edge. The upper body garment can include at least one first connector positioned adjacent the interior surface of the garment and spaced a desired distance from the bottom edge.

The lower body garment can include a waist edge defining a waist opening. The lower body garment includes at least one second connector. The second connector is positioned on the lower body garment so as to vertically align with the first connector on the upper body garment when both garments are being worn together. In accordance with the present disclosure, the second connector is configured to engage the first connector for securing the upper body garment to the lower body garment.

For instance, in one embodiment, the second connector may comprise a retaining member. The retaining member can comprise a flap having a first end and a second end. The flap can be attached to the lower body garment at the first end on an exterior surface of the garment. The second end of the flap, on the other hand, can be in association with a fastener. In this manner, the second end can be attachable and releasable from the lower body garment using the fastener.

The first connector on the upper body garment, on the other hand, can comprise an elastic loop-like member. In one embodiment, the flap on the lower body garment can be opened and placed through the loop-like member and then attached to the lower body garment using the fastener. In this manner, the lower body garment becomes attached and integrated with the upper body garment. Thus, the upper body garment cannot separate and rise above the lower body garment even when the garment system is worn in extreme environments or when the wearer is engaged in a physical activity. In this manner, the garment system provides maximum protection, such as fire protection, while remaining modular and thus comfortable and unencumbering.

In the above embodiment, the first connector comprises a loop-like member, while the second connector comprises a retaining member that includes a flap and fastener. In other embodiments, however, it should be understood that the second connector may comprise a loop-like member while the first connector may comprise a retaining member as described above.

In one particular embodiment, the lower body garment can include a plurality of belt loops spaced around the waist opening. A plurality of retaining members can be placed on top of and integrated with the belt loops. For each retaining member, the upper body garment can include a corresponding first connector. For example, in one embodiment, the garment system can include from about two to about seven corresponding pairs of first connectors and retaining members, such as from about two to about five corresponding pairs of connectors and retaining members. In one particular embodiment, the garment system can include one or two pairs of loop-like members and retaining members located on the back of the garment system and one or two pairs of loop-like members and retaining members located on the front of the garment system.

In addition to being used together, the upper body garment and the lower body garment of the present disclosure may also have utility when used alone. For example, the retaining members contained on the lower body garment can be used in other applications to attach the lower body garment to various other items, such as keys, tools, or any other collateral or apparel items.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which:

FIG. 1 is a perspective view of one embodiment of a garment system made in accordance with the present disclosure;

FIG. 2 is a perspective view of the garment system shown in FIG. 1, illustrating attachment between an upper body garment and a lower body garment;

FIG. 3 is another perspective view of the garment system illustrated in FIG. 1 showing the garment system after the upper body garment has been attached to the lower body garment;

FIGS. 4A and 4B are cross-sectional views of one embodiment of an attachment system in accordance with the present disclosure;

FIG. 5 is a plan view of the attachment system illustrated in FIGS. 4A and 4B.

Figure 6:
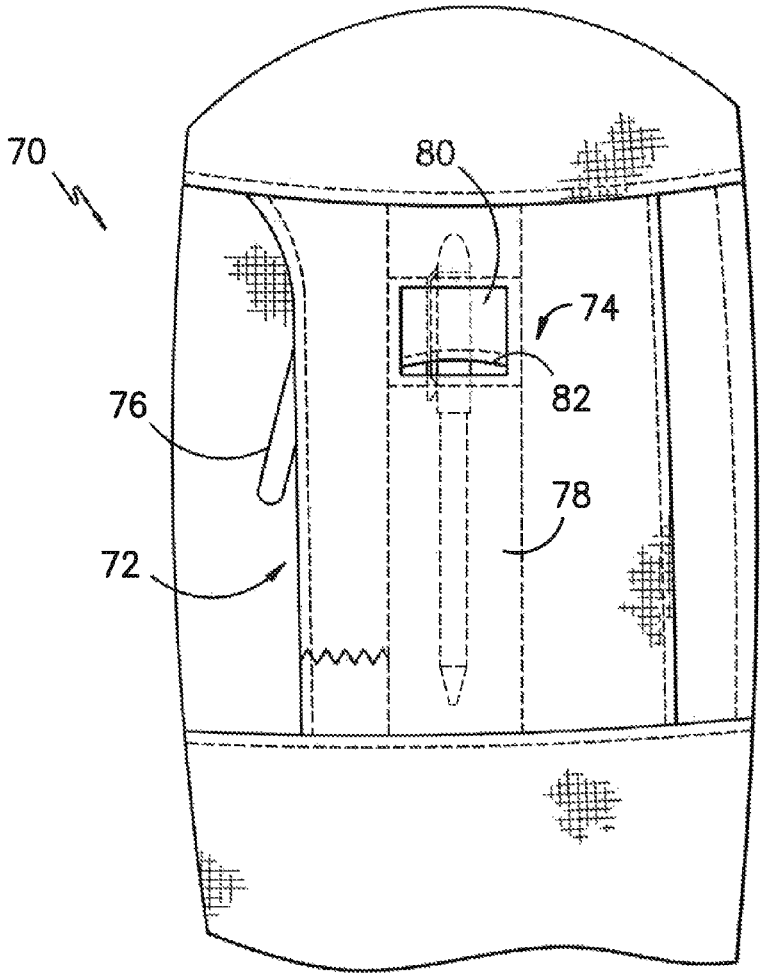
FIG. 6 is a plan view of one embodiment of a pocket that may be incorporated into the garment system of the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to a garment system comprised of a plurality of garments that attach together to form a unitary and integrated protective covering for the wearer. In one embodiment, for instance, the garment system includes an upper body garment and a lower body garment. In accordance with the present disclosure, the upper body garment includes one or more connectors that can engage one or more corresponding connectors on the lower body garment. The connectors on the upper body garment can be positioned on the interior of the garment, while the connectors can be positioned on the exterior of the lower body garment. The connectors on the upper body garment are capable of securely attaching to the connectors on the lower body garment while still allowing flexibility. Thus, even though the garment system includes at least two separate pieces of clothing items, the items can be attached together so as to have performance characteristics similar to a full body suit.

For example, by attaching the upper body garment to the lower body garment, the two garments do not separate and expose the wearer when subjected to extreme conditions, such as fire and explosions, wind, cold temperatures, or other severe weather conditions, such as conditions associated with rain and snow.

Of particular advantage, in one embodiment, the connectors located on the lower body garment can be incorporated into or otherwise can comprise the existing belt loops. For example, in one embodiment, the connector on the lower body garment comprises a retaining member that includes a flap on a corresponding belt loop that is engageable and releasable from the belt loop, such as by using a hook and loop fastener. Integrating the retaining members into the belt loops eliminates excess bulk, snag points, or the necessity to add further parts to the garment that may need to be replaced in the future. In addition, incorporating the retaining members into the belt loops does not substantially change the overall appearance of the lower body garment, which may be important in certain military applications where the garment is to have a regulation appearance.

Incorporating an attachment system as described above, also allows for the garment system of the present disclosure to be modular. In particular, the attachment system does not substantially change as the size of the garment changes. Thus, a wearer can mix and match different sized upper body garments with different sized lower body garments in order to maximize fit and comfort. The garment system, for instance, can easily accommodate the widest range of body types without adversely interfering with the attachment system. In this manner, the garment maker can manufacture different sized garments without having to create a garment specifically tailored for an individual.

Ultimately, a garment system is produced that is trim, unencumbered, and provides the wearer with an excellent range of motion and protection. Various different fabrics can be used to produce the garments which can also dramatically increase durability and moisture management.

The garment system of the present disclosure can be used in numerous and diverse applications. In one embodiment, for instance, the fabric used to produce the garment system can have fire resistant characteristics. Thus, the garment system can be worn in any occupation where there is a risk of exposure to fire. For example, the garment system may be worn by firefighters, military personnel including combat troops, industrial workers, and the like.

In one particular embodiment, the garment system is designed to be worn by a flight crew. When worn by flight crew members, the garment system can not only provide protection from exposure to fires, but can also provide protection against other elements the flight crew may be exposed. For instance, the garment system provides excellent wind resistance and water resistance depending upon the fabric that is used to make the garment system. When worn by military flight crews, the garment system can also provide protection against biological agents, incendiary devices, and the like.

Referring to FIGS. 1-5, one embodiment of a garment system made in accordance with the present disclosure is shown. The garment system illustrated in the figures is particularly designed to be worn by flight crew personnel, such as military flight crew. As described above, however, the garment system may be used in other diverse applications.

As shown in FIG. 1, the garment system 10 of the present disclosure can include an upper body garment 12 and a lower body garment 14. The upper body garment 12 may comprise a jacket or a coat that is intended to be worn over other clothing. Alternatively, the upper body garment 12 may comprise a shirt, such as a combat shirt. As shown, the upper body garment 12 includes a neck opening 16 defined by a collar 18. The neck opening 16 is opposite a bottom edge 20. The upper body garment 12 further includes a first sleeve 22 and a second sleeve 24. In the embodiment illustrated, the upper body garment 12 includes a zipper 26 that facilitates donning the garment. In other embodiments, however, the garment may be made without a zipper and may be designed to be pulled over one's head.

As shown in FIG. 2, the upper body garment 12 includes an interior surface 28 configured to be worn adjacent a wearer and an opposite exterior surface 30. Located on the interior surface 28 is a draw cord 32. The draw cord, which may be made from an elastic material, can be drawn by a user in order to tighten the bottom edge around the lower body garment and the wearer. The draw cord 32, for instance, may be placed in association with a locking element that releasably locks the draw cord 32 into an extended position when desired. The draw cord 32, for instance, may extend around substantially the entire circumference of the bottom edge 20 of the upper body garment 12.

In accordance with the present disclosure, the upper body garment 12 further includes one or more first and second connectors for connecting the upper body garment to the lower body garment. In the embodiment illustrated in FIG. 2, for instance, the upper body garment includes three first connectors 34, 36 and 38. In the embodiment illustrated, the first connectors 34, 36 and 38 have a loop-like structure and can be made from a cord, such as an elastic cord. The cord can have two ends that are bartacked to the garment where seams are located. As shown, the first connectors 34, 36 and 38 are located on the interior surface 28 of the upper body garment and are spaced a distance from the bottom edge 20. For example, the first connectors can be spaced from the bottom edge a distance of from about one-half inch to about 12 inches, such as from about 1 inch to about 6 inches.

Referring to FIG. 5, the upper body garment first connector 34 is shown in greater detail. In one embodiment, the first connector 34 can include a tab member 40. As will be described in greater detail below, the tab member 40 can be provided so that a user can locate the first connector 34 and pull on the tab member 40 when attaching the first connecter to the lower body garment.

Referring to FIG. 1, the lower body garment 14 generally includes a waist edge 44 that defines a waist opening 46. The waist opening 46 is opposite two leg openings. For instance, the lower body garment 14 can include a first pant leg 48 and a second pant leg 50. As can be appreciated, the lower body garment 14 can include various pockets as may be desired. In the embodiment illustrated, for instance, the lower body garment includes calf pockets 52 positioned below hand pockets 54. In the embodiment illustrated, the hand pockets 54 are zippered pockets with dual openings.

As shown in FIG. 1, the lower body garment 14 may also include a plurality of belt loops 56. The belt loops 56 are for receiving a waist belt that encircles the waist opening 46.

In accordance with the present disclosure, the lower body garment 14 further comprises at least one connector, such as a retaining member, that is designed to interconnect with a corresponding connector on the upper body garment. The lower body garment connectors are desirably located on an exterior surface of the lower body garment, but may also be applied to the interior surface in some applications. In the embodiment illustrated in FIGS. 1-5, the lower body garment connectors are located on top of the belt loops 56. Each belt loop can include a corresponding connector. Alternatively, only certain of the belt loops may be present in association with a corresponding connector.

In the embodiment illustrated in FIG. 2, the lower body garment 14 includes three second connectors 58, 60 and 62.

In the embodiment illustrated in the figures, the upper body garment first connectors 34, 36, 38 comprise loop-like members, while the lower body garment second connectors 58, 60, 62 may comprise retaining members as will be described in greater detail below. It should be understood, however, that the attachment system can be reversed such that the loop-like members are present on the lower body garment and the retaining members are present on the upper body garment. In yet another embodiment, the upper body garment first connectors 34, 36, 38 may comprise a mixture of loop-like members and retaining members while the lower body garment second connectors 58, 60, 62 may include a corresponding mix of loop-like members and retaining members.

As shown in FIG. 2, each lower body garment second connector comprises a retaining member 58, 60 and 62. Each retaining member generally comprises a flap that is attached to an exterior surface of a corresponding belt loop. The flap includes a first end adjacent the waist edge 44 and a second and opposite end. The first end is permanently attached to the lower body garment 14. The second end of the flap, on the other hand, is releasably attached to the corresponding belt loop. In particular, each retaining member includes a fastener located in between the flap and the exterior surface of the belt loop. In general, any suitable fastener may be used. The fastener may comprise, for instance, a snap fit connector, such as a cantilever snap, an annular snap, a trap, or a dart. Other suitable fasteners include push-pull connectors, buckles, retaining rings, snaps, cantilever spring fasteners, crush rib fasteners, carabiners, and the like. In one embodiment as shown in the figures, the fastener may comprise a hook and loop fastener. In FIG. 2, for instance, a hook material is located on the flap of each retaining member while a loop material is attached to the exterior surface of the belt loop. In other embodiments, however, the position of the materials can be reversed.

Referring now to FIGS. 2, 4A, 4B and 5, the manner in which the first connector 34 is attached to the second connector (i.e. retaining member) 58 is shown in more detail. As shown in FIG. 2, once the upper body garment 12 and the lower body garment 14 are donned, the two garments can be attached together using the first connectors 34, 36 and 38 and the corresponding second connectors 58, 60 and 62. In order to attach the two garments together, as shown in FIG. 5, the fastener located on the second connector 58 is released causing the flap 66 to pivot upwards. At the same time, a user can pull on the first connector 34 located on the interior surface of the upper body garment and bring the loop-like structure in close proximity to the flap 66.

As shown in FIG. 4A, the flap 66 has been placed within the first connector 34. In particular, the flap 66 is placed through an opening formed by the loop-like structure of the first connector 34.

Once the flap 66 of the second connector 58 has engaged the first connector 34, the flap 66 can be pivoted in a downwards direction and closed as shown in FIG. 4B. When closed, the fastener on the second connector 58 engages causing a secure attachment between the first connector 34 and the second connector 58. In the embodiment illustrated in FIGS. 4A and 4B, the connection occurs on top of the belt loop 56. It should be understood, however, that in other embodiments belt loops may not be needed on the lower body garment. In these embodiments, the second connector 58 can be located directly on the exterior surface of the lower body garment.

In the embodiment illustrated in FIG. 2, the garment system 10 includes three first connectors located on the upper body garment and three corresponding second connectors on the lower body garment which are in vertical alignment with the first connectors when the garments are donned. It should be understood, however, that more or less first connectors and second connectors may be present in the garment system. In general, the garment system may contain from one to about seven corresponding pairs of first connectors and second connectors, such as from about two to about five corresponding pairs.

Referring to FIG. 3, the garment system 10 is shown once the upper body garment 12 is attached to the lower body garment 14 in accordance with the present disclosure. Once the upper body garment is attached to the lower body garment, the upper body garment is prevented from being forced up and separating from the lower body garment and exposing the wearer. In addition, the draw cord 32 can be tightened further securing the upper body garment to the lower body garment. Thus, once the two garments are attached, the garment system comprises a unitary and integrated protective covering. As described above, the garment system 10 can protect the wearer from extreme weather and other hazardous conditions. In addition, the garment system remains modular allowing a wearer to mix and match different sized top garments with different sized bottom garments so as to maximize fit and comfort. The garment system not only provides maximum protection to the wearer, but also allows for a full range of motion.

In one embodiment, the garment system 10 is designed to protect the wearer from flash fires, explosions, and open flames. In this regard, the garment system can be made from a fabric that has flame resistant properties. For instance, the fabric can contain inherently flame resistant yarns alone or in combination with other yarns that may have flame resistant properties. Inherently flame resistant yarns include, for instance, yarns made from aramid fibers such as aromatic polyamide fibers. Such fibers include meta-aramid fibers, para-aramid fibers, and combinations thereof. Other inherently flame resistant fibers include polybenzimidazole fibers.

The inherently flame resistant yarns may be combined with various other yarns. The other yarns can contain cellulosic fibers, such as cotton fibers and rayon fibers, and synthetic fibers, such as nylon fibers, polyester fibers, and the like.

In one embodiment, the fabric used to produce the garment system may contain yarns or fibers treated with a flame retardant composition. The yarns can include, for instance, FR cotton fibers, FR rayon fibers, modacrylic fibers, and the like.

In addition to containing flame resistant yarns or instead of using flame resistant yarns, the fabric may be treated with a flame retardant composition. The flame retardant composition may contain, for instance, a phosphorus compound or a halogenated compound, such as a bromine compound.

In one embodiment, the fabric can also contain elastomeric yarns. Such yarns may comprise monofilament and/or multifilament yarns and can include, for instance, SPANDEX yarns. The elastomeric yarns can be incorporated into the fabric in an amount from about 0.25% to about 20% by weight, such as from about 0.5% to about 10% by weight. The elastomeric yarns can provide the fabric with stretch and recovery properties that can improve comfort and fit.

Fabrics used to make the garment system can have any suitable fabric construction. For instance, the fabrics can be knitted or woven. Knitted fabrics that may be constructed in accordance with the present disclosure include warp knitted fabrics or weft knitted fabrics. Types of knitted fabrics that may be made in accordance with the present disclosure include tricot knits, milanese knits, raschel knits, circular knits, flat knits, jersey knits, and the like.

Woven fabrics that may be used include fabrics having a plain weave, a twill weave, a rip stop weave or the like.

The basis weight of fabrics used to make the garment system can vary widely depending upon the particular application. In general, the fabrics can have a basis weight of from about 3 osy to about 12 osy, such as from about 4 osy to about 9 osy.

In one embodiment, the garment system 10 as shown in FIG. 1 may include a multipurpose pocket as illustrated in FIG. 6. Although the pocket may be placed at any suitable location on the garment system, in one embodiment, the pocket is placed on the sleeve of the upper body garment. As will be described in greater detail below, the multipurpose pocket is particularly well suited for use in conjunction with flight crew suits.

Referring to FIG. 6, the pocket 70 has a first opening 72 and a second opening 74. The first opening 72, for instance, may be defined by a zipper 76. The zipper 76 may open and close for exposing a first compartment. If desired, the multipurpose pocket 70 may include a pleat that expands the size of the first compartment.

The second opening 74 leads to a second compartment 78. As shown, the second compartment 78 is particularly well suited for holding writing instruments, such as a pen.

Adjacent the opening 74 of the second compartment 78 is a protective flap 80. The protective flap 80 is attached to the second compartment 78 along three sides leaving only a single free open end 82. The open end 82 in conjunction with the exterior surface of the second compartment 78 renders the opening 74 in the shape of a slit for receiving pens and other writing instruments.

In general, the protective flap 80 allows for pens and other writing instruments to be easily inserted into the second compartment 78. When the writing instrument needs to be secured within the pocket, however, a user can grasp the open end 82 of the protective flap 80 and pull it over the writing instrument so that the writing instrument is secured within the pocket. When the garment system is used as a flight suit, for instance, writing instruments are needed but should also be secured within the garment so that they do not fall out during flight or other extreme conditions.

In the past, pen pockets on flight suits included a conventional flap that was attached to the exterior surface of the pocket and was only connected on one end. Thus, the flap was pivoted upward to access the pocket and then pivoted downward and fastened in order to secure items within the pocket.

The pocket construction illustrated in FIG. 6, however, provides various advantages and benefits over conventional flap pen pockets. For example, as described above, writing instruments can be easily inserted into the second compartment 78 without having to open or pivot upwards a flap. In addition, the protective flap 80 is flush with the exterior surface of the second compartment 78. In this manner, the exterior surface of the second compartment 78 lays completely flat and prevents snagging on adjacent objects.

The protective flap 80 can be made from various materials. In one embodiment, for instance, the protective flap 80 can be made from the same material that is used to make the rest of the multipurpose pocket. In other embodiments, however, the protective flap 80 may be made from a different material, such as a material that has stretch or elastic properties. For instance, in one embodiment, the protective flap 80 may be made from an elastic material containing elastomeric filaments.

In one embodiment, the pocket 70 as shown in FIG. 6 may be backed by a mesh material to provide venting, especially when the garment is made from fire resistant fabrics. In fact, all of the pockets on the garment, including chest pockets, shoulder pockets and pant pockets can all include a backing made from a mesh material. When the garment system is designed to have fire resistant characteristics, the mesh can also be made from a fire resistant material. For instance, the mesh can be made from inherently flame resistant fibers or from fibers treated with a flame retardant composition. Alternatively or in addition to being made from flame resistant fibers, the mesh material may also be treated with a flame retardant composition.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A garment system comprising:

an upper body garment having an interior surface configured to be worn adjacent to a wearer and an opposite exterior surface, the upper body garment including a pair of opposing arm sleeves and a bottom edge, the opposing arm sleeves configured to completely cover both arms of the wearer, the upper body garment including at least one first connector positioned adjacent the interior surface of the garment spaced from the bottom edge; and a separate lower body garment also having an interior surface and an opposite exterior surface, the lower body garment including a waist edge defining a waist opening, a first pant leg, and a second pant leg, the first and second pant legs configured to completely cover both legs of the wearer, the lower body garment comprising a plurality of belt loops permanently attached to the waist edge and that are spaced around the waist opening adjacent to the waist edge, the lower body garment comprising at least one retaining member affixed directly to a corresponding belt loop, the retaining member being affixed on the lower body garment so as to vertically align with the first connector on the upper body garment when both garments are being worn together, the first connector being configured to engage the retaining member for securing the upper body garment to the lower body garment, wherein a portion of the interior surface of the upper body garment overlays and contacts a portion of the exterior surface of the lower body garment when secured, and wherein the garment system is constructed of a fire-resistant material that protects the wearer from hazardous conditions comprising fire, extreme temperatures, chemical hazards, biological hazards, or extreme environmental conditions.

2. A garment system as defined in claim 1, wherein the retaining member comprises a flap and a fastener, the flap comprising an inside surface facing the lower body garment, the fastener releasably attaching the flap to the lower body garment.

3. A garment system as defined in claim 2, wherein the flap includes a first end and a second end, the flap being attached to the lower body garment at the first end, the second end being attachable and releasable from the lower body garment using the fastener.

4. A garment system as defined in claim 3, wherein the first end of the flap is located adjacent to the waist opening and the second end of the flap is positioned farther away from the waist opening than the first end.

5. A garment system as defined in claim 4, wherein the flap is located on top of the corresponding belt loop.

6. A garment system as defined in claim 5, wherein the garment system includes a plurality of retaining members on the lower body garment and a corresponding plurality of first connectors on the upper body garment, the retaining members being positioned on at least some of the belt loops.

7. A garment system as defined in claim 6, wherein the upper body garment includes three first connectors and the lower body garment includes three corresponding second connectors.

8. A garment system as defined in claim 6, wherein the first connector on the upper body garment comprises a member forming a loop.

9. A garment system as defined in claim 8, wherein the first connector is comprised of an elastic cord.

10. A garment system as defined in claim 6, wherein the upper body garment further comprises a draw cord positioned along the bottom edge.

11. A garment system as defined in claim 1, wherein the first connector on the upper body garment comprises a member forming a loop.

12. A garment system as defined in claim 11, wherein the first connector is comprised of an elastic cord.

13. A garment system as defined in claim 11, wherein the upper body garment further comprises a draw cord positioned along the bottom edge.

14. A garment system as defined in claim 1, wherein the upper body garment and the lower body garment are made from a flame resistant fabric.

15. A garment system as defined in claim 1, wherein the upper body garment and the lower body garment together comprise a flight suit.

16. A garment system as defined in claim 1, wherein the upper body garment further comprises a draw cord positioned along the bottom edge.

17. An article of clothing comprising:

a lower body garment having an interior surface configured to be worn adjacent a wearer and an opposite exterior surface, the lower body garment including a waist edge defining a waist opening, a first pant leg, and a second pant leg, the first and second pant legs configured to completely cover both legs of the wearer;

a plurality of belt loops permanently attached to the waist edge and that are spaced around the waist opening of the lower body garment, the belt loops being positioned adjacent the waist edge; and a plurality of retaining members, each retaining member being affixed directly to a corresponding belt loop, the retaining members being configured to attach to an adjacent object, the retaining members comprising a flap and a fastener, the flap including an inside surface facing the belt loop and an opposite outside surface, the fastener releasably attaching the flap to the belt loop, wherein a portion of an interior surface of an upper body garment overlays and contacts a portion of the exterior surface of the lower body garment when attached, and wherein the article of clothing is constructed of a fire-resistance material that protects the wearer from hazardous conditions comprising fire, extreme temperatures, chemical hazards, biological hazards, or extreme environmental conditions.

18. An article of clothing as defined in claim 17, wherein the flap of each retaining member includes a first end and a second end, the flap being attached to a corresponding belt loop at the first end, the second end being attachable and releasable to the belt loop using the fastener.

19. An article of clothing as defined in claim 18, wherein the first end of each flap is located adjacent to the waist opening and the second end of each flap is positioned farther away from the waist opening than the first end.

20. An article of clothing as defined in claim 17, wherein the article of clothing includes three retaining members.

21. An article of clothing as defined in claim 20, wherein the lower body garment includes a front and a back, a plurality of retaining members being positioned in the front of the lower body garment and one retaining member being positioned at the back of the lower body garment.

22. An article of clothing as defined in claim 17, wherein the lower body garment is comprised of a fabric containing flame resistant fibers.

23. An article of clothing as defined in claim 22, wherein the flame resistant fibers comprise aramid fibers, natural or synthetic fibers treated with a flame retardant, or mixtures thereof.

24. An article of clothing as defined in claim 17, wherein the lower body garment is comprised of a fabric that has been treated with a flame retardant composition.

* * * * *